US007872558B2

(12) United States Patent
Sakuma

(10) Patent No.: US 7,872,558 B2
(45) Date of Patent: Jan. 18, 2011

(54) COIL DEVICE WITH BOBBIN STRUCTURE

(75) Inventor: Sadakatsu Sakuma, Sendai (JP)

(73) Assignee: NEC TOKIN Corporation, Sendai-shi (JP)

( * ) Notice: Subject to any disclaimer, the term of this patent is extended or adjusted under 35 U.S.C. 154(b) by 0 days.

(21) Appl. No.: 12/501,583

(22) Filed: Jul. 13, 2009

(65) Prior Publication Data

US 2010/0013588 A1 Jan. 21, 2010

(30) Foreign Application Priority Data

Jul. 17, 2008 (JP) ..... 2008-185452

(51) Int. Cl.
*H01F 27/30* (2006.01)

(52) U.S. Cl. ..... 336/192; 336/208; 336/198

(58) Field of Classification Search ..... None
See application file for complete search history.

(56) References Cited

U.S. PATENT DOCUMENTS 4,443,777 A * 4/1984 Koike ..... 336/65
4,617,543 A * 10/1986 Akachi et al. ..... 336/192
4,945,332 A * 7/1990 Sakamoto et al. ..... 336/69
5,157,368 A * 10/1992 Okano et al. ..... 336/90
6,696,908 B2 * 2/2004 Okano et al. ..... 336/198

FOREIGN PATENT DOCUMENTS

JP 2000-150258 A 5/2000
JP 2004-260089 A 9/2004
JP 2005-72261 A 3/2005
JP 2008-147265 A 6/2008

* cited by examiner

*Primary Examiner*—Anh T Mai
(74) *Attorney, Agent, or Firm*—Holtz, Holtz, Goodman & Chick, PC

(57) ABSTRACT

A coil device having a bobbin structure, includes a body section, a first flange section and a second flange section. The body section is positioned between the first flange section and the second flange section in a first horizontal direction. The first flange section includes a first lower base and a first upper portion. The first upper portion extends upwardly from the first lower base. The first upper portion is provided with a first upper edge on which at least one guide recess is formed. The second flange section includes a second lower base and a second upper portion. The second lower base faces the first lower base in the first horizontal direction. The second upper portion extends upwardly from the second lower base. The second upper portion faces the first upper portion in the first horizontal direction with the body section interposed therebetween.

6 Claims, 8 Drawing Sheets

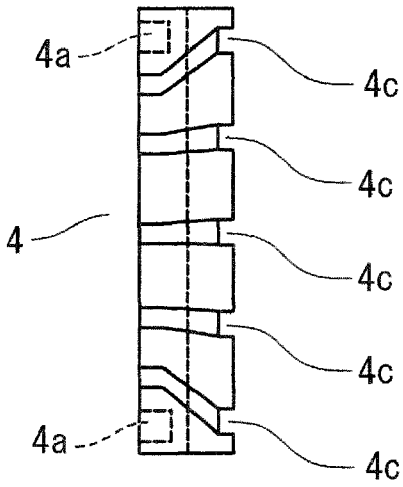
FIG. 6A
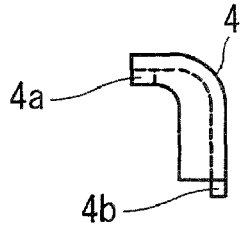
FIG. 6B
FIG. 6C
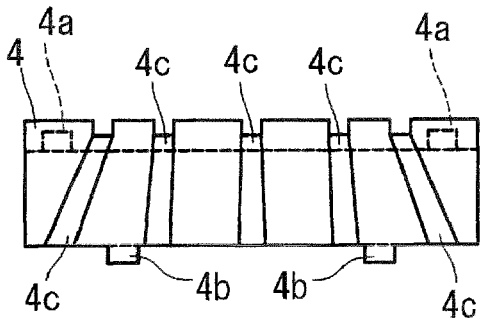
FIG. 6D
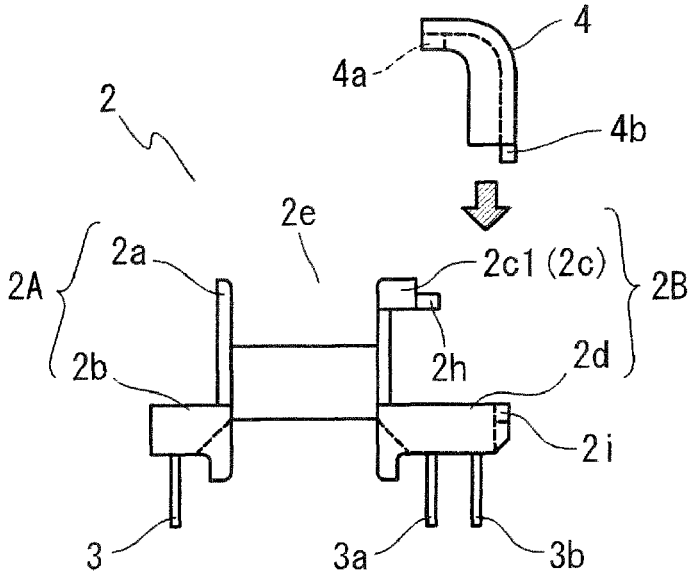

COIL DEVICE WITH BOBBIN STRUCTURE

CROSS REFERENCE TO RELATED APPLICATIONS

An applicant claims priority under 35 U.S.C. §119 of Japanese Patent Application No. JP2008-185452 filed Jul. 17, 2008.

BACKGROUND OF THE INVENTION

This invention relates to a coil device such as a transformer or a choke coil used in an inverter circuit or the like and, in particular, to a low-profile coil device which includes a bobbin structure and coils wrapped around the bobbin structure.

Coil devices are generally grouped into two types: vertical type and horizontal type. A coil device of the vertical type has coils which are arranged so that their coil axes extend vertically. Another coil device of the horizontal type has coils which are arranged so that their coil axes extend horizontally. Recently, coil devices are required to have a low-profile with more coils. In view of the requirement, the horizontal-type coil device has advantages in its characteristics in comparison with the vertical-type coil device. For example, one of the horizontal-type coil devices is disclosed in JP-A 2005-72261, the contents of which are incorporated herein by reference.

As disclosed in JP-A 2005-72261, a normal coil device of the horizontal type has two pin lines, each of which consists of multiple pins or terminals. If the number of coils increases, each of the pin lines must be longer. The longer pin lines lose the size balance of the coil device.

In order to solve the above-mentioned size balance problem, JP-A 2004-260089 proposes a coil device of horizontal type that has four pin lines, the contents of JP-A 2004-260089 being incorporated herein by reference. However, the coil device of JP-A 2004-260089 has a complex structured coil bobbin formed with a plurality of holes which pierces its flange portions along a direction parallel with its coil axes. Because of the piercing holes, the complex structured coil bobbin is difficult to mold and does not have its adequate strength. JP-A 2000-150258 and JP-A 2008-147265 disclose other coil devices each of which comprises three or more pin lines but is of the vertical type. Therefore, the coil device of JP-A 2000-150258 or JP-A 2008-147265 is difficult to have a low-profile with multiple coils, as mentioned above.

SUMMARY OF THE INVENTION

It is an object of the present invention to provide a coil device which can have a low-profile with adequate strength even if it has and a small size but has many pins One aspect of the present invention provides a coil device which comprises a bobbin structure, three or more pin lines and two or more coils. The bobbin structure comprises a body section, a first flange section and a second flange section. The body section is positioned between the first flange section and the second flange section in a first horizontal direction. The first flange section comprises a first lower base and a first upper portion. The first upper portion extends upwardly from the first lower base. The first upper portion is provided with a first upper edge on which at least one guide recess is formed. The second flange section comprises a second lower base and a second upper portion. The second lower base faces the first lower base in the first horizontal direction. The second upper portion extends upwardly from the second lower base. The second upper portion faces the first upper portion in the first horizontal direction with the body section interposed therebetween. Each of the pin lines consists of two or more pins arranged in a second horizontal perpendicular to the first horizontal direction. Two or more of the pin lines extend downwardly from the first lower base. One or more of the pin lines extends downwardly from the second lower base. Each of coils comprises a wrapped portion and two twisted portions extending from the wrapped portion. The wrapped portions of the coils are wrapped around the body section of the bobbin structure so that the coils have their axes extending along the first horizontal direction. Each of the twisted portions is twisted around one of the pins. At least one of the twisted portions is guided by the at least one guide recess and extends over the first upper edge to a corresponding one of the pins.

An appreciation of the objectives of the present invention and a more complete understanding of its structure may be had by studying the following description of the preferred embodiment and by referring to the accompanying drawings.

BRIEF DESCRIPTION OF THE DRAWINGS

FIG. 6A is a top plan view schematically showing the cover member of FIG. 5A.

FIG. 6B is a side view schematically showing the cover member of FIG. 6A.

FIG. 6C is a front view schematically showing the cover member of FIG. 6A.

FIG. 6D is an exploded, side view schematically showing the bobbin structure of FIG. 5A.

Figure 1A:
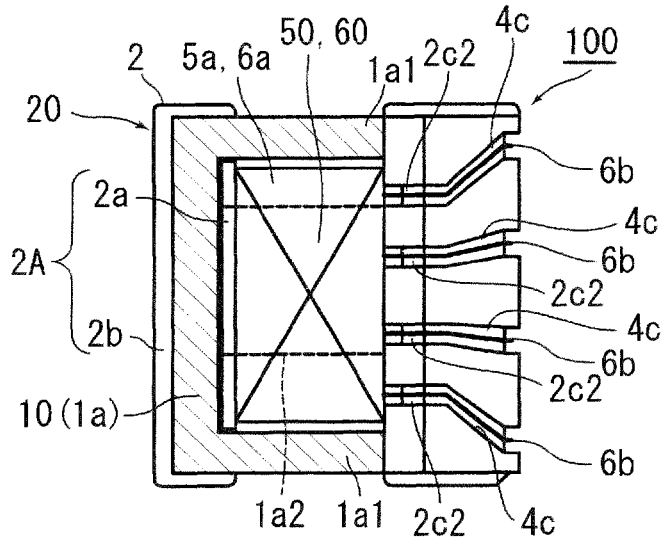
FIG. 1A is a top plan view schematically showing a coil device according to an embodiment of the present invention, wherein the coil device includes a bobbin structure.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 1B:
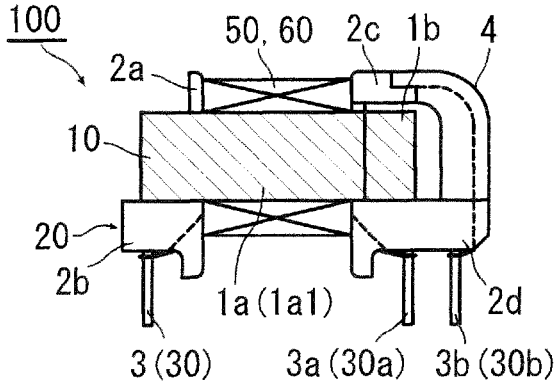
FIG. 1B is a side view schematically showing the coil device of FIG. 1A.
Figure 1C:
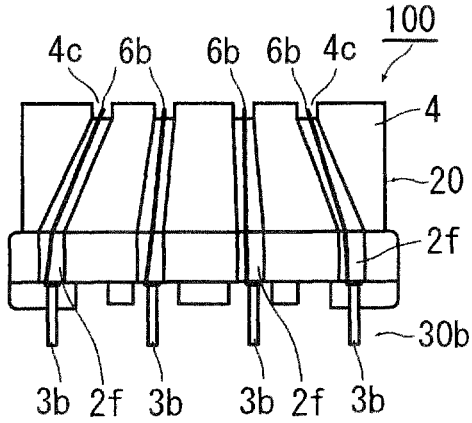
FIG. 1C is a front view schematically showing the coil device of FIG. 1A.
Figure 1D:
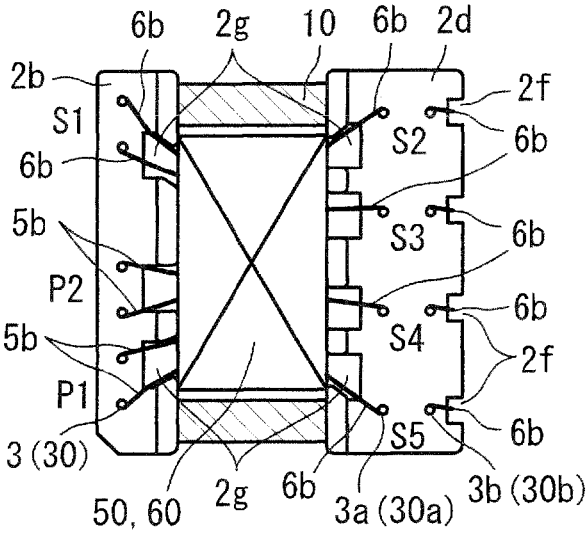
FIG. 1D is a bottom plan view schematically showing the coil device of FIG. 1A.
Figure 1E:
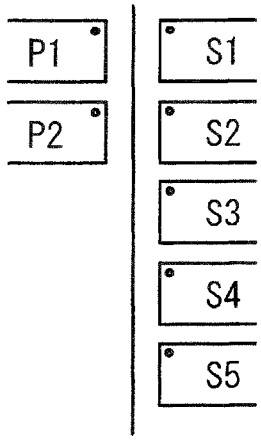
FIG. 1E is a circuit diagram schematically showing of equivalent circuits of the coil device of FIG. 1A.

With reference to FIGS. 1A to 1D, a coil device 100 according to a first embodiment of the present invention comprises a magnetic core 10, a bobbin structure 20, three pin lines 30, 30*a*, 30*b*, a plurality of primary coils 50 and a plurality of secondary coils 60. As shown in FIGS. 1D and 1E, the number of the primary coils 50 (primary circuits P1, P2) is two, while the number of the secondary coils 60 (secondary circuits S1 to S5) is five in the present embodiment.

With reference to FIGS. 1A, 1B and 1D, the magnetic core 10 of the present embodiment is of an EI type and comprises an E-shaped core 1*a* and an I-shaped core 1*b*. The E-shaped core 1*a* includes two side legs 1*a*1 and a center leg 1*a*2. The side legs 1*a*1 and the center leg 1*a*2 are parallel with each other. Each of the side legs 1*a*1 and the center leg 1*a*2 extends in a first horizontal direction, which is a lateral direction in FIGS. 1A, 1B and 1D. The center leg 1*a*2 serves as an inserted portion which is inserted into and is held by the bobbin structure 20, as explained in later. The I-shaped core 1*b* extends in a second horizontal direction which is perpendicular to the first horizontal direction and is another lateral direction in FIG. 1C. The I-shaped core 1*b* serves as an outer portion which is held by the bobbin structure 20, as explained in later. As apparent from FIGS. 1B and 2B, the center leg 1*a*2 is thinner than the remaining parts of the magnetic core 10, especially, the I-shaped core 1*b* and the side legs 1*a*1 so that the coil device 100 of the present embodiment has a lower-profile. However, the present invention is not limited thereto. The center leg 1*a*2 may be thicker than the illustrated one. For example, the center leg 1*a*2 may have a thickness equal or substantially equal to the I-shaped core 1*b* and/or the side legs 1*a*1. It is preferable that the magnetic core 10 is made of Mn—Zn based ferrite or Ni—Zn based ferrite, in consideration of high permeability, low loss, and suitability to high frequency. In addition, the magnetic core 10 may be made of magnetic amorphous. Also, a dust core may be used as the magnetic core 10. It is preferable that the material of the magnetic core 10 is selected in consideration of the application of the magnetic core 10.

With reference to FIGS. 2A to 2D and FIG. 3D, the bobbin structure 20 of the present embodiment comprises a bobbin main 2 and a cover member (cover section) 4. In this embodiment, the bobbin main 2 and the cover member 4 are distinct members, and the bobbin structure 20 is a combination thereof. However, the present invention is not limited thereto. The bobbin main 2 and the cover section 4 may be formed integrally with each other. In other words, the bobbin structure 10 may be formed as a single member.

Figure 2A:
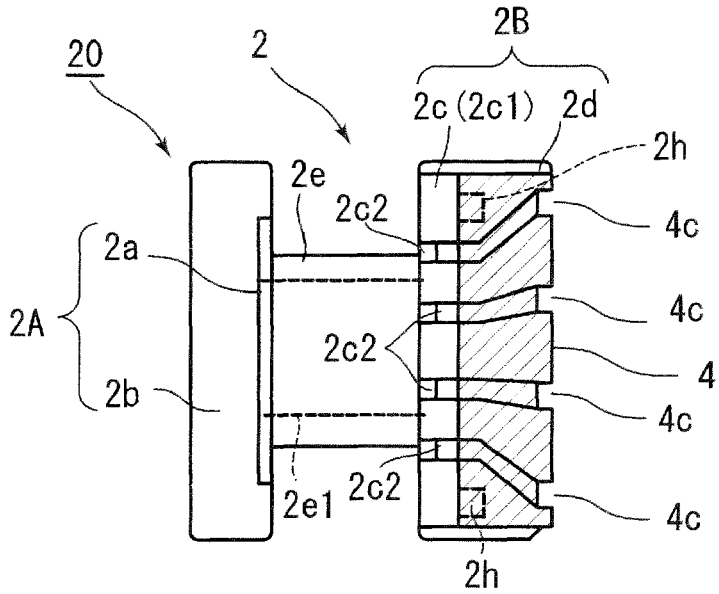
FIG. 2A is a top plan view schematically showing the bobbin structure of FIG. 1A, wherein the bobbin structure comprises a main member and a cover member.

The illustrated bobbin main 2 comprises a body section 2*e*, a first flange section 2B and a second flange section 2A. As best shown in FIG. 2A, the bobbin main 2 is formed with a hollow 2*e*1 which extends in the first horizontal direction and into which the center leg 1*a*2 is inserted as the inserted portion, as apparent from FIGS. 1A and 2A.

Turning back to FIGS. 2A to 2D and FIG. 3D, the body section 2*e* is positioned between the first flange section 2B and the second flange section 2A in the first horizontal direction. The first flange section 2B comprises a first lower base 2*d* and a first upper portion 2*c*, which extends upwardly from the first lower base 2*d*. The second flange section 2A comprises a second lower base 2*b* and a second upper portion 2*a*, which extends upwardly from the second lower base 2*b*. The second lower base 2*b* faces the first lower base 2*d* in the first horizontal direction. Likewise, the second upper portion 2*a* faces the first upper portion 2*c* in the first horizontal direction with the body section 2*e* interposed between the first upper portion 2*c* and the second upper portion 2*a*.

Figure 2B:
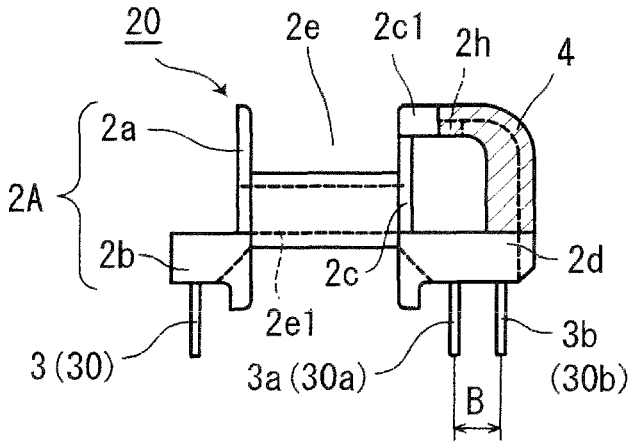
FIG. 2B is a side view schematically showing the bobbin structure of FIG. 2A.
Figure 2C:
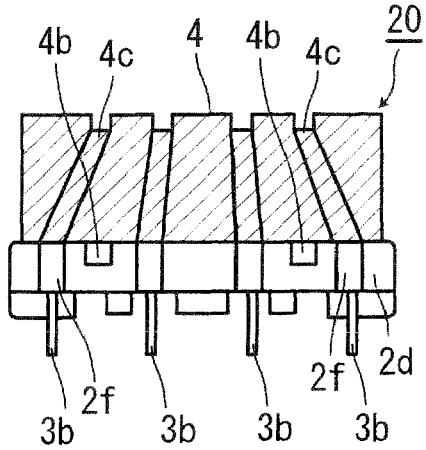
FIG. 2C is a front view schematically showing the bobbin structure of FIG. 2A.

In this embodiment, the second upper portion 2*a* has a simple plate-like shape, while the first upper portion 2*c* has a plate-like shape with a first upper edge 2*c*1 which projects outwards in the first horizontal direction. As shown in FIGS. 1A and 2A, the first upper edge 2*c*1 is formed with guide recesses 2*c*2. The number of the guide recesses 2*c*2 of four in the present embodiment. The guide recesses 2*c*2 serve to guide the coils (the secondary coils 60) in part, as illustrated in FIG. 1A; the guide of the parts of the coils are also explained afterwards. As shown in FIGS. 2A, 2B and 3D, the first upper edge 2*c*1 of the present embodiment is formed with two projections 2*h* which further project outwards in the first horizontal direction. As shown in FIG. 3D, the first lower base 2*d* is formed with two depressions 2*i*, which are positioned at one end of the first lower base 2*d* in the first horizontal direction and are depressed downwardly. The first lower base 2*d* is formed with guide grooves 2*f* and guide depressions 2*g*. The guide grooves 2*f* are positioned on an outer side surface of the first lower base 2*d*. The guide depressions 2*g* are positioned at an inner-lower edge of the first lower base 2*d*. Likewise, the second lower base 2*b* is also formed with guide depressions 2*g* which are positioned at an inner-lower edge of the second lower base 2*b*.

Figure 3A:
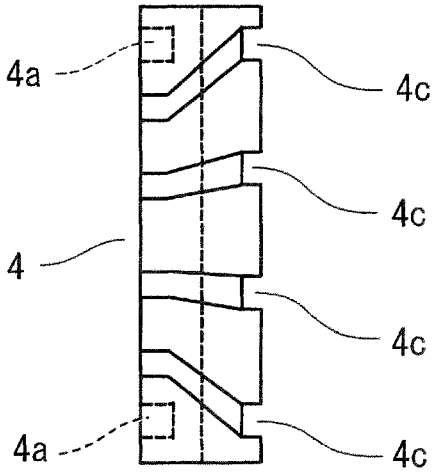
FIG. 3A is a top plan view schematically showing the cover member of FIG. 2A.
Figure 3B:
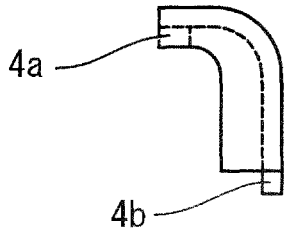
FIG. 3B is a side view schematically showing the cover member of FIG. 3A.

With reference to FIGS. 2B and 3B, the cover member 4 has a general L-like shape, as seen along the second horizontal direction. The cover member 4 connects between the first upper edge 2*c* and the first lower base 2*d* to define a space extending along the second horizontal direction. As shown in FIG. 1B, the I-shaped core 1*b*, i.e. the outer portion of the magnetic core 10 is disposed on the first lower base 2*d* and is accommodated in the defined space. In other words, the cover member 4 covers the outer portion of the magnetic core 10, i.e. the I-shaped core 1*b*.

Figure 3C:
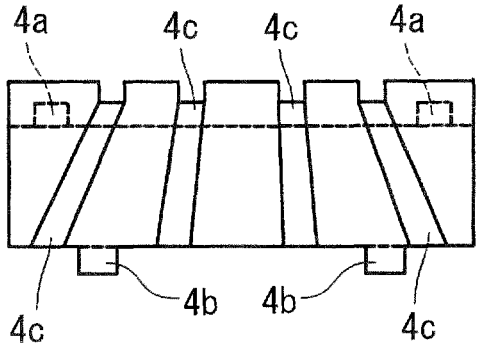
FIG. 3C is a front view schematically showing the cover member of FIG. 3A.
Figure 3D:
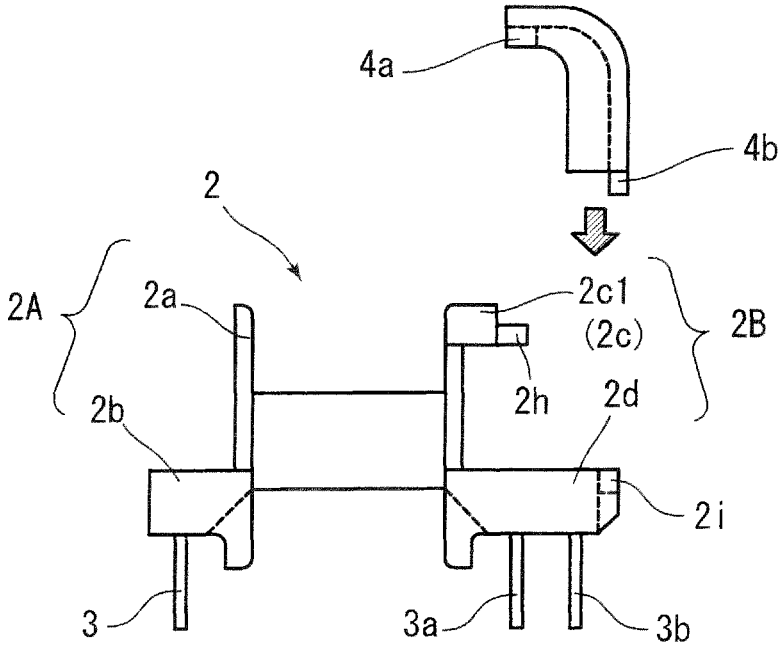
FIG. 3D is an exploded, side view schematically showing the bobbin structure of FIG. 2A.
Figure 4A:
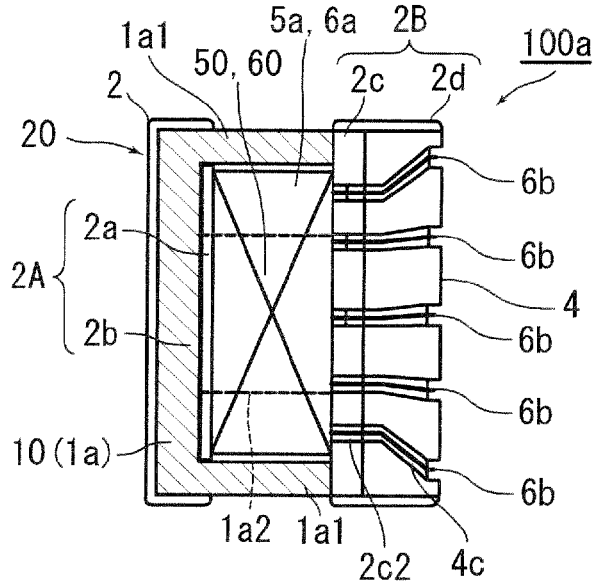
FIG. 4A is a top plan view schematically showing a coil device according to another embodiment of the present invention, wherein the coil device includes a bobbin structure.
Figure 4B:
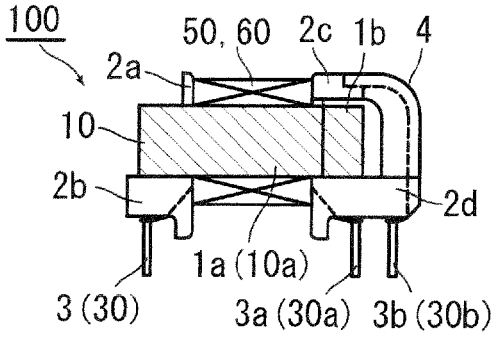
FIG. 4B is a side view schematically showing the coil device of FIG. 4A.
Figure 4C:
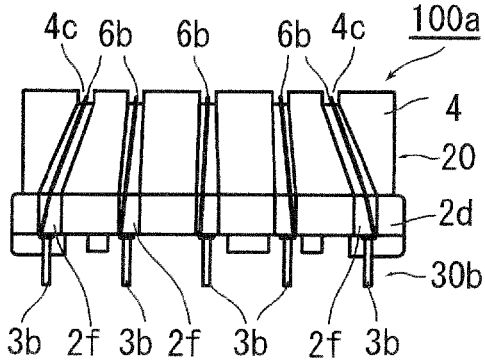
FIG. 4C is a front view schematically showing the coil device of FIG. 4A.
Figure 4D:
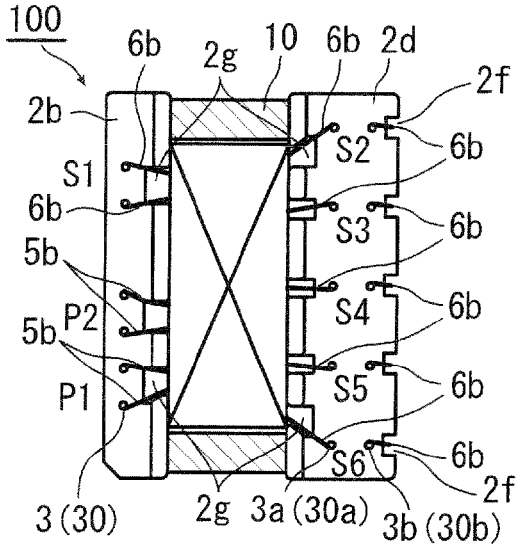
FIG. 4D is a bottom plan view schematically showing the coil device of FIG. 4A.
Figure 4E:
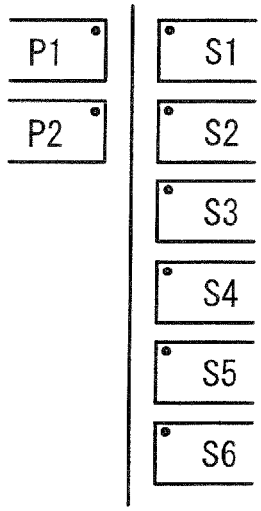
FIG. 4E is a circuit diagram schematically showing of equivalent circuits of the coil device of FIG. 4A.
Figure 5A:
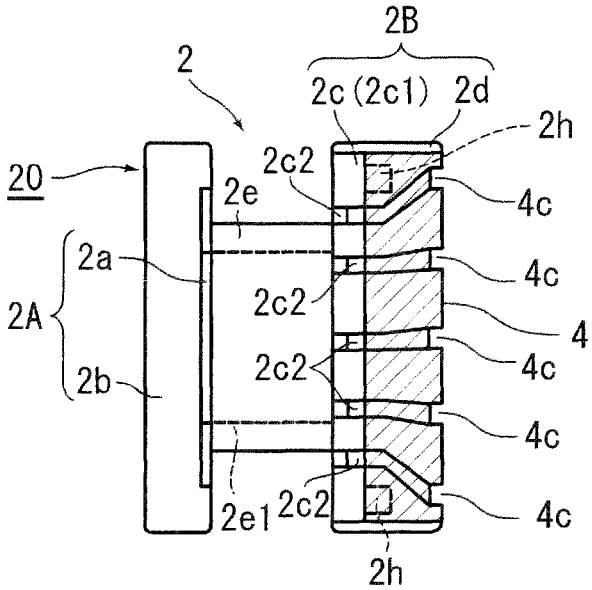
FIG. 5A is a top plan view schematically showing the bobbin structure of FIG. 4A, wherein the bobbin structure comprises a main member and a cover member.
Figure 5B:
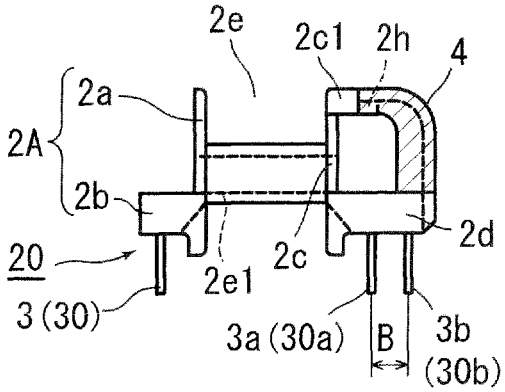
FIG. 5B is a side view schematically showing the bobbin structure of FIG. 5A.
Figure 5C:
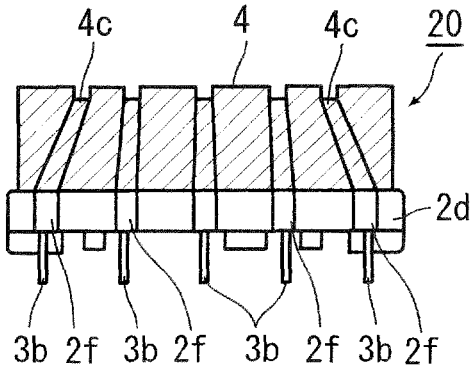
FIG. 5C is a front view schematically showing the bobbin structure of FIG. 5A.
Figure 5D:
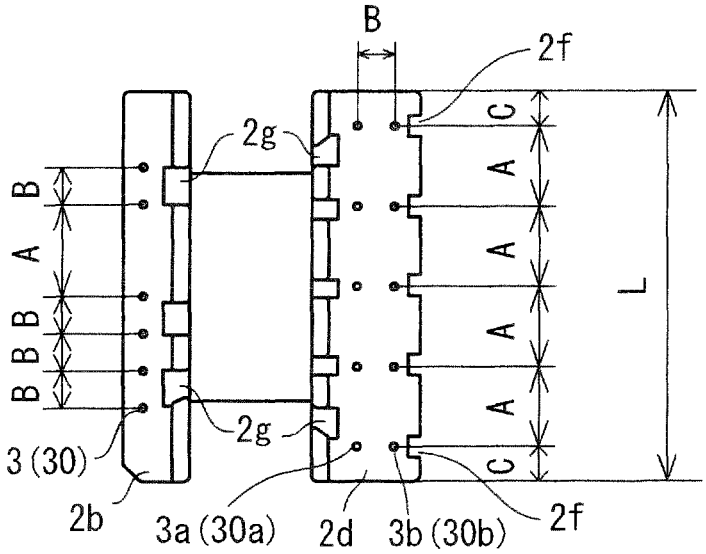
FIG. 5D is a bottom plan view schematically showing the bobbin structure of FIG. 5A.

With reference to FIGS. 3B and 3C, the cover member 4 is formed with two depressions 4*a* and two projections 4*b*. As apparent from FIG. 3D, the depressions 4*a* receive the projections 2*h*, respectively, while the projections 4*b* are received by the depressions 2*i*, respectively. With reference to FIGS. 1C, 2A, 2C, 3A and 3C, a plurality of guide grooves 4*c* are formed in an outer surface of the cover member 4. The guide grooves 4*c* correspond to the guide recesses 2*c*2, respectively. The number of the guide grooves 4*c* is four in the present embodiment. The guide grooves 4*c* serve to guide the coils (the secondary coils 60) in part, as illustrated in FIGS. 1A and 1C; the guide of the parts of the coils are also explained afterwards.

The bobbin structure 20 may be made of thermosetting resin or thermoplastic resin. Examples of the thermosetting resin are epoxy resin, phenol resin and so on. Examples of the thermoplastic resin are polypropylene, polystyrene, polybutylene terephthalate, nylon and so on. The bobbin main 2 may be made of different material than the cover member 4. The body section 2*e* may have any shape. It is preferable that the body section 2*e* has a rectangular cross-section in consideration of low profile requirement for the coil device 100. However, it is further preferable that the rectangular cross-section of the body section 2*e* has rounded corners in consideration of possibility of damage of the coils. For the same reason, the guide grooves 2*f*, 4*c* and the guide depressions 2*g* are preferably rounded.

Figure 2D:
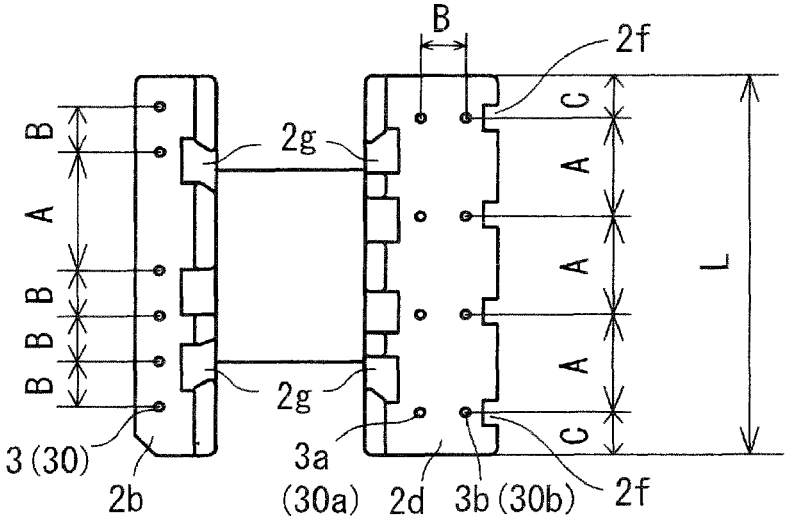
FIG. 2D is a bottom plan view schematically showing the bobbin structure of FIG. 2A.

With reference to FIGS. 1B, 1D, 2B and 2D, the pin line 30 is held by the second lower base 2*b*, while the pin lines 30*a*, 30*b* are held by the first lower base 2*d*. Specifically, the pin line 30*a* is an inner pin line, while the pin line 30*b* is an outer pin line. In other words, the pin line 30*a* is positioned inside the pin line 30*b* in the first horizontal direction. Each of the pin lines 30, 30*a*, 30*b* consists of a plurality of pins 3, 3*a*, 3*b*, which are arranged in the second horizontal direction. Specifically, the pin line 30 consists of six pins 3; the pin line 30*a* consists of four pins 3*a*; the pin line 30*b* consists of four pins 3*b*. Each of the pins 3, 3*a*, 3*b* extends downwardly from a corresponding one of the first lower base 2*d* and the second lower base 2*b*. In this embodiment, each pair of the pin 3*a* and the pin 3*b* is arranged along the first horizontal direction, as shown in FIGS. 1D and 2D. The pin arrangement makes the size of the bobbin structure 20 small. The pins 3, 3*a*, 3*b* may be made of any conductive material. It is preferable that the pins may be made of copper-plated metal wire or hard-drawn copper wire because of low cost. The pins 3, 3*a*, 3*b* may have a cross-section of any shape.

With reference to FIG. 1A, each of the primary coils 50 comprises a wrapped portion 5*a* and two twisted portions 5*b*. The wrapped portion 5*a* is wrapped around the body section 2*e* so that the primary coil 50 has its axis extending along the first horizontal direction. The twisted portions 5*b* extend from both ends of the wrapped portion 5*a*. Each of the twisted portions 5*b* is guided by one of the guide depressions 2*g* and is twisted around a corresponding one of the pins 3, as shown in FIG. 1D.

Likewise, with reference to FIG. 1A, each of the secondary coils 60 comprises a wrapped portion 6*a* and two twisted portions 6*b*. The wrapped portion 6*a* is wrapped around the body section 2*e* so that the secondary coil 60 has its axis extending along the first horizontal direction. The twisted portions 6*b* extend from both ends of the wrapped portion 6*a*. Each of the twisted portions 6*b* is twisted around a corresponding one of the pins 3, 3*a*, 3*b*. As shown in FIG. 1D, one pair of the twisted portions 6*b* is guided by one of the guide depressions 2*g* to be twisted around the pins 3. These twisted portions 6*b* twisted around the pin 3 belong to the secondary circuit S1. As shown in FIGS. 1A, 1C and 1D, ones of the twisted portions 6*b* belonging to the remaining pairs extend from the wrapped portion 6*a* over the first upper edge 2*c* to the pins 3*b* of the outer pin line 30*b*, respectively, and are twisted around the pins 3*b*. The other twisted portions 6*b* of the remaining pairs are guided by the guide depressions 2*g* and are twisted around the pins 3*a* of the inner pin line 30*a*, respectively. These twisted portions 6*b* twisted around the pins 3*a*, 3*b* belong to one of the secondary circuits S2 to S5. In this embodiment, the twisted portions 6*b* twisted around the pins 3*b* are guided by the respective guide recesses 2*c*2 of the first upper edge 2*c* and the respective guide grooves 4*c* of the cover member 4. Because of the cover member 4, the guided twisted portions 6*b* are positioned away from and are separated from the magnetic core 10.

Each of the primary coils 50 and the secondary coils 60 may be made of any materials such as enameled wire or polyurethane coated copper wire. Reinforced insulation wire may be used. Each of the primary coils 50 and the secondary coils 60 may have any cross-section.

The above-mentioned coil device 100 is fabricated by as follows. The wrapped portions 5*a*, 6*a* are wrapped around the body section 2*e*, while the cover member 4 is attached to the bobbin main 2. The twisted portions 5*b*, 6*b* are twisted around the pins 3, 3*a*, 3*b*. The I-shaped core 1*b* is inserted into the space defined by the cover member 4 and the first flange section 2B. The center leg 1*a*2 of the E-shaped core 1*a* is inserted into the hollow 2*e*1. The E-shaped core 1*a* is fixed to the I-shaped core 1*b* by for example an adhesive agent. The thus-fabricated coil device 100 has a good size balance, while the pins 3*a*, 3*b* are sufficiently separated from each other, because the pins 3*a*, 3*b* are arranged in two pin lines 30*a*, 30*b*.

Although the shape of the magnetic core 10 is of the EI-type, the shape of the magnetic core 10 may be other shapes such as an EE-type core. If the EE-type core is used, the core is attached to the bobbin main 2 before the cover member 4 is attached to the bobbin main 2. The center leg of the magnetic core 10 also may have any shape. In view of low profile requirement, it is preferable that the center leg has a rectangular cross-section. Although the bobbin structure 20 of the present embodiment has only one cover member 4, the bobbin structure 20 may have two cover members 4, which are attached to the first flange section 2B and the second flange section 2A, respectively. In the case of two cover members 4, the magnetic core 10 is attached to the bobbin main 2 before the cover members 4 are attached to the bobbin main 2.

With reference to FIGS. 4A to 4E, 5A to 5D, and 6A to 6D, a coil device 100*a* according to a second embodiment of the present invention is a modification of the coil device 100 of the first embodiment. The coil device 100*a* is different from the coil device 100 in the number of circuits, i.e. the number of coils. The coil device 100*a* comprises two primary circuits P1, P2 and six secondary circuits S1 to S6. In this connection, the pin line 30*a* consists of five pins 3*a*, while the pin line 30*b* consists of five pins 3*b*. In addition, the first upper edge 2*c*1 is formed with five guide recesses 2*c*2, the cover member 4 is formed with five guide grooves 4*c*, and the first lower base 2*d* is formed with five guide grooves 2*f*. The coil device 100*a* has a good size balance, while the pins 3*a*, 3*b* are sufficiently separated from each other, because the pins 3*a*, 3*b* are arranged in two pin lines 30*a*, 30*b*.

Examples and comparative examples were fabricated and were evaluated.

Example 1 was the coil device 100 according to the first embodiment. In FIG. 2D, the size A was 6 mm, the size B was 2.5 mm, the size C was 2 mm. The magnetic core 10 was of the EI-type and was made of Mn—Zn based ferrite. The E-shaped core 1*a* had a profile of 15 mm×13 mm×4.5 mm. The center leg had a rectangular cross-section which had rounded corners of 0.5 mm curve. The I-shaped core 1*b* had a shape of 15 mm×2 mm×4.5 mm. The bobbin main 2 was made of phenol based thermosetting resin. Each of the guide grooves 2*f* and the guide depressions 2*g* had a width of 1 mm and a depth of 1 mm. In order to prevent damage of the coil, the guide grooves 2*f* and the guide depressions 2*g* were rounded at 0.5 mm curve. The cover member 4 was made of polystyrene thermoplastic resin and had a shape of 6 mm×20 mm×8 mm (height). Each of the guide grooves 4*c* had a width of 1 mm and a depth of 1 mm. In order to prevent damage of the coil, the guide grooves 4*c* were rounded at 0.5 mm curve. Each of the primary coils 50 was formed of twelve turns of polyurethane coated copper wire, which had a diameter of 0.3 ϕ. Each of the secondary coils 60 was formed of twenty turns of insulated wires, which had a diameter of 0.15 ϕ. The twisted portions 5*b* and 6*b* were twisted around the pins 3, 3*a*, 3*b* and were then fixed by soldering.

Figure 7A:
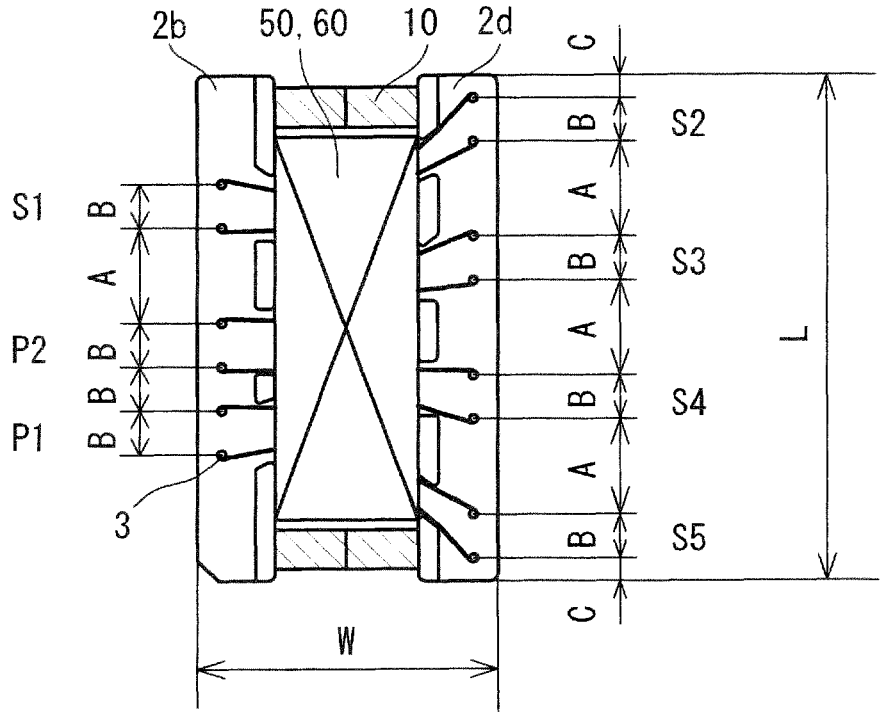
FIG. 7A is a bottom plan view schematically showing a coil device according to a first comparative example.
Figure 7B:
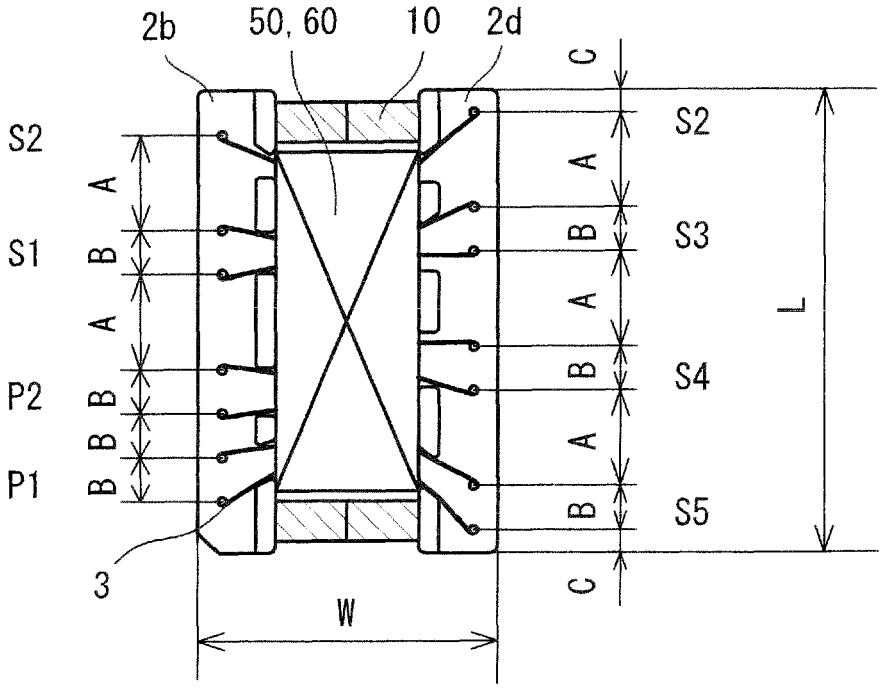
FIG. 7B is a bottom plan view schematically showing a coil device according to a second comparative example.

Comparative Example 1 and Comparative Example 2 were fabricated in accordance with FIGS. 7A and 7B, respectively, Comparative Example 2 had a smaller size L than Comparative Example 1 by size B because the twisted portions of the circuit S2 were twisted around the pins which were fixed to the different lower bases 2*d*, 2*b*.

The evaluation result is shown in Table 1.

TABLE 1

| | Number of Circuits | Implementation Area ($mm^2$) | Plane Size of Magnetic Core (mm × mm) | Weight of Magnetic Core (g) |
|---|---|---|---|---|
| Example 1 | P: 2; S: 5 | 495<br>L 22 × W 22.5 | 18.4 × 24.2 | 8.2 |
| Comparative Example 1 | P: 2; S: 5 | 640<br>L 32 × W 20 | 18.4 × 34.0 | 11.6 |
| Comparative Example 2 | P: 2; S: 5 | 590<br>L 29.5 × W 20 | 18.4 × 30.9 | 10.5 |

P: Primary Circuit,
S: Secondary Circuit

As apparent from Table 1, Example 1 has an implementation area which is about 80% of that of Comparative Example 1 or Comparative Example 2. The weight of the magnetic core of Example 1 is decreased by about 22% in comparison with Comparative Example 1 or Comparative Example 2.

Figure 8:
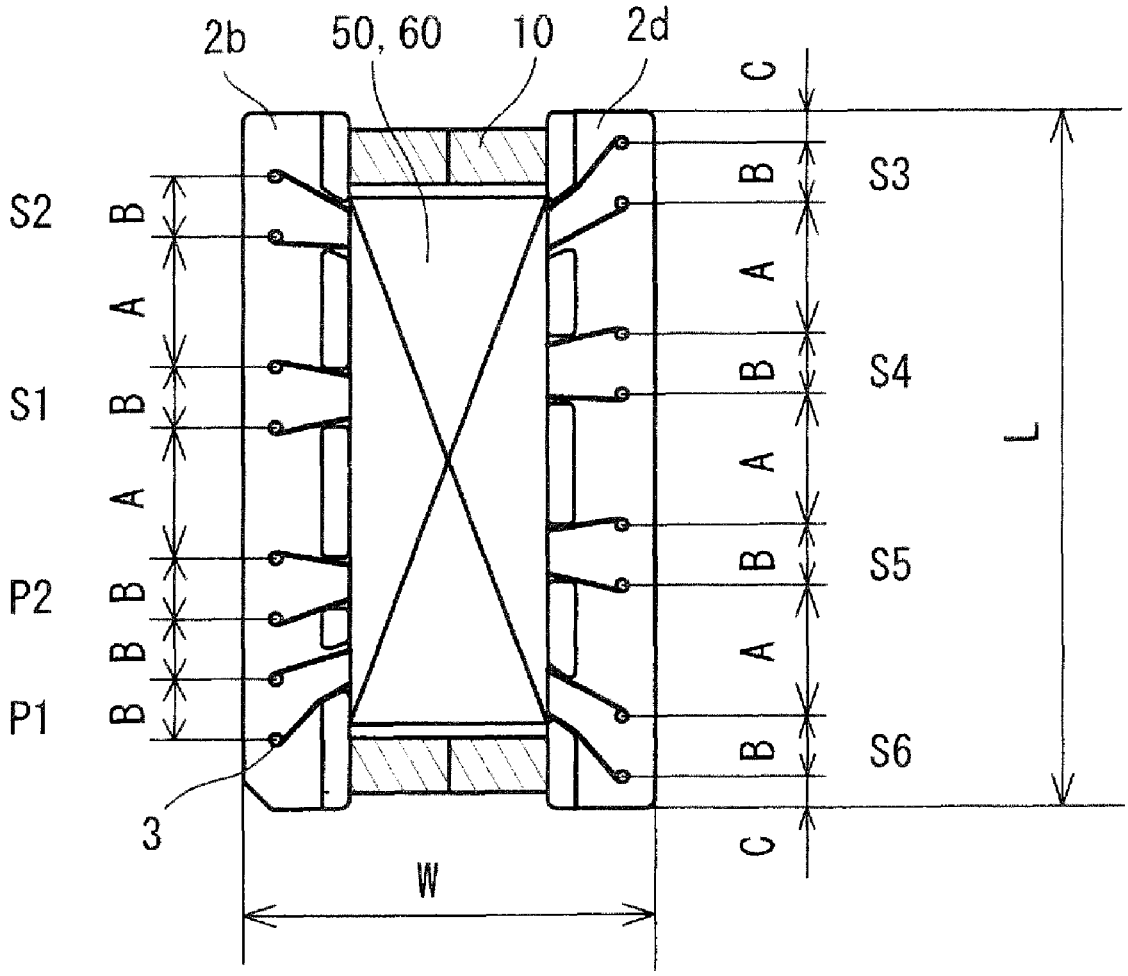
FIG. 8 is a bottom plan view schematically showing a coil device according to a third comparative example.

Example 2 was the coil device 100*a* according to the second embodiment, Example 2 was fabricated in accordance with conditions similar to Example 1, except for the number of the secondary coils 60. For example, In FIG. 5D, the size A was 6 mm, the size B was 2.5 mm, the size C was 2 mm. Comparative Example 3 was fabricated in accordance with FIG. 8.

The evaluation result is shown in Table 2.

TABLE 2

| | Number of Circuits | Implementation Area ($mm^2$) | Plane Size of Magnetic Core (mm × mm) | Weight of Magnetic Core (g) |
|---|---|---|---|---|
| Example 2 | P: 2; S: 6 | 630<br>L 28 × W 22.5 | 18.4 × 30.9 | 10.5 |
| Comparative Example 3 | P: 2; S: 6 | 640<br>L 32 × W 20 | 18.4 × 34.0 | 11.6 |

P: Primary Circuit,
S: Secondary Circuit

As apparent from Table 2, Example 2 has an implementation area smaller than that of Comparative Example 3. The weight of the magnetic core of Example 2 is decreased by about 10% in comparison with Comparative Example 3. The plane size of the magnetic core of Example 2 is smaller than that of Comparative Example 3 and is equivalent to that of Comparative Example 2 which has the small number of coils.

The present application is based on a Japanese patent application of JP2008-185452 filed before the Japan Patent Office on Jul. 17, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A coil device comprising:

a bobbin structure comprising a body section, a first flange section and a second flange section, the body section being positioned between the first flange section and the second flange section in a first horizontal direction, the first flange section comprising a first lower base and a first upper portion, the first upper portion extending upwardly from the first lower base, the first upper portion being provided with a first upper edge on which at least one guide recess is formed, the second flange section comprising a second lower base and a second upper portion, the second lower base facing the first lower base in the first horizontal direction, the second upper portion extending upwardly from the second lower base, and the second upper portion facing the first upper portion in the first horizontal direction with the body section interposed therebetween;

at least three pin lines, each of the pin lines comprising at least two pins arranged in a second horizontal direction perpendicular to the first horizontal direction, wherein at least two of the pin lines extend downwardly from the first lower base, and at least one of the pin lines extends downwardly from the second lower base; and at least two coils, each of coils comprising a wrapped portion and two twisted portions extending from the wrapped portion, the wrapped portions of the coils being wrapped around the body section of the bobbin structure so that axes of the coils extend along the first horizontal direction, each of the twisted portions being twisted around one of the pins, and at least one of the twisted portions being guided by the at least one guide recess and extending over the first upper edge to a corresponding one of the pins.

2. The coil device according to claim 1, wherein:

the first lower base is provided with two of the pin lines, and the pin lines include an inner pin line and an outer pin line;

respective ones of the twisted portions are twisted around the pins belonging to the inner pin line; and respective other ones of the twisted portions are twisted around the pins belonging to the outer pin line.

3. The coil device according to claim 1, wherein the coil device further comprises a magnetic core, and wherein:

the magnetic core comprises an inserted portion and an outer portion;

the bobbin structure is formed with a hollow extending therethrough along the first horizontal direction;

the inserted portion is inserted into the hollow;

the outer portion is arranged on the first lower base;

the bobbin structure comprises a cover section;

the cover section connects between the first upper edge and the first lower base to cover the outer portion of the magnetic core; and the at least one twisted portion is arranged on an outer surface of the cover section so as to be positioned away from the magnetic core.

4. The coil device according to claim 3, wherein the cover section is provided with at least one guide groove which corresponds to the at least one guide recess and which is formed on the outer surface of the cover section, the at least one guide groove guiding the at least one twisted portion from the wrapped portion through the at least one guide recess of the first upper edge to the pin around which the at least one twisted portion is twisted.

5. The coil device according to claim 3, wherein the magnetic core is of an EI type, which comprises an E-shaped core and an I-shaped core, and wherein the E-shaped core includes two side legs and a center leg positioned between the side legs, and the center leg forms the inserted portion of the magnetic core.

6. The coil device according to claim 5, wherein the I-shaped core forms the outer portion of the magnetic core.

* * * * *